United States Patent [19]

Codatto

[11] Patent Number: 4,836,004

[45] Date of Patent: Jun. 6, 1989

[54] FOLDING PRESS FOR PLATES

[76] Inventor: Antonio Codatto, Via Alcide de Gasperi 20, Lonigo (Vicenza), Italy

[21] Appl. No.: 214,413

[22] Filed: Jul. 1, 1988

[30] Foreign Application Priority Data

Jul. 3, 1987 [IT] Italy ..... 85572 A/87

[51] Int. Cl.[4] ..... B21D 5/04

[52] U.S. Cl. ..... 72/323; 72/322; 72/316

[58] Field of Search ..... 72/322, 323, 316, 312, 72/315

[56] References Cited

U.S. PATENT DOCUMENTS

| | | | |
|---|---|---|---|
| 826,807 | 7/1906 | Slaysman, Jr. | 72/323 |
| 3,054,437 | 9/1962 | Laxo | 721/322 |
| 4,658,624 | 4/1987 | Ridgway et al. | 72/323 |
| 4,658,625 | 4/1987 | Koyama et al. | 72/323 |

*Primary Examiner*—Daniel C. Crane

*Attorney, Agent, or Firm*—Bucknam and Archer

[57] ABSTRACT

The folding press provides two blades 7 and 8 which are supported and actuated by a cutter block 6 which is C-shaped and which is movable in the vertical direction with respect to two counterblades 1 and 5 between which the plate 19 is placed. The cutter block 6 is actuated by one or more cylinders 9 of the fluid-dynamic type and and in its rear part has rolling elements 14 and 15 which move on tracks 16 and 17, the latter extending essentially in the vertical direction and having curved portions 18 at the extremities. The rolling elements travelling on the tracks cause the cutter block 6 to make a motion of curvilinear shape, a fact which causes the operation of the blades 7 and 8 and the folding of the plates. There are also provided an eccentric structure 12 and a pivot 13' which are capable of varying the position of the cylinders 9 so as to vary the folding angle of the border of the plate 19 upwardly or downwardly, the folding being determined respectively by the lower blade 8 and by the upper blade 7.

4 Claims, 2 Drawing Sheets

FOLDING PRESS FOR PLATES

The present invention relates to a press capable of producing folds on plates for the purpose of manufacturing panels folded corresponding to their borders along one or more of their sides.

According to the present state of art some apparatuses are known called folding presses which comprise essentially a lower counterblade and an upper counterblade acting as a blank holder, both of which extend essentially in a longitudinal direction supported by a suitable structure. These presses comprise also a carriage which supports and determines simultaneously the motions of an upper folding blade and a lower folding blade which cooperate with the counterblades mention hereinabove and carry out the folding step downwardly or upwardly along the borders of the extremity of a plate, the latter being kept in position by the counterblades.

Obviously it is necessary to prearrange suitable structures for the purpose of determining the motions of the folding blades so as to obtain the upward or the downward fold of the borders of the plates. It is also necessary to dispose preliminarily suitable means of regulation for the folding angle which the blades must determine along the borders of the plates.

These known devices require complicated structural elements and are inherently complicated in the manner of operation due to the requirement of preliminarily regulating the position as well as the requirement of controlling of the displacement of the blades during the folding step. Specifically in one of these known devices the folding blade is mounted on a pivot which is horizontally disposed and a wedge-shaped rod is provided to act on the blade. The wedge is displaceable in the longitudinal direction and the displacement could vary the inclination of the blade with respect to the pivot. Also, the devices capable of actuating the blade are several and complex because they consist of a plurality of aligned pistons which are disposed corresponding to the entire length of the blade and which act on the blade and are capable of determining the rotation in a preestablished direction, being intended to overcome the action of a plurality of biasing means which would tend to push the blade in the opposite direction.

The object of the present invention is to provide a folding press for plates which is structurally and functionally much simpler than similar devices known in the art. According to a specific embodiment of the invention, two blades are fixed to a cutter block which has the shape of a C and which is actuated by one or a plurality of fluid-dynamic cylinders. The position of the cylinders may be predetermined by acting on a shaft longitudinally disposed along the entire length of the device. The shaft is pivoted at the extremity corresponding to the fixed lateral sides of the press because one or a plurality of eccentric elements is located around the shaft and the eccentric elements are located corresponding to each of the cylinders. The eccentric elements are located in a suitable seat provided on the lower extension of the cylinders. In actual practice the angular position of the shaft is capable of determining the position of the cylinders and therefore predetermining the folding angle assumed by the plate as soon as the hydraulic cylinder or the hydraulic cylinders perform their function.

An essential feature of the invention resides in the fact that corresponding to the rear part of the C-shaped structure which supports the folding blades are provided rolling elements which move on suitably shaped paths so as to determine the forward displacement along a predetermined curve of the same structure, when one of the blades is brought in front of the counterblade so that the blades may perform their folding function.

In actual practice the device according to the present invention is structurally much simpler than similar known devices because it is sufficient to have a single element for the control of the angular position of the shaft mentioned hereinabove for the purpose of predetermining the folding angle of the plates. By means of the device according to the invention it is also possible to obtain with great simplicity a folding of the blades of very few degrees as well as along angles much greater than 90° with respect to the original position of the planer blade.

The device according to the present invention is illustrated according to a specific embodiment by way of example which is not intended to limit the invention, by reference to the accompanying drawings of which:

Figure 1:
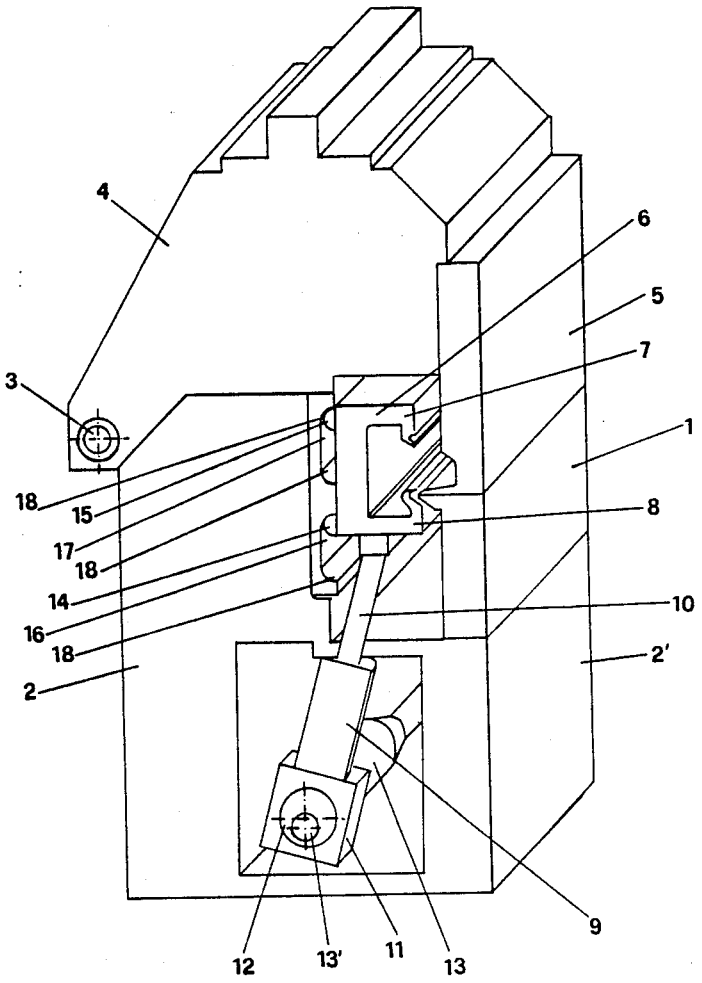
FIG. 1 is an axonometric view of the overall device according to a specific embodiment of the invention.

FIG. 1 shows a first embodiment of the invention. The device comprises a lower counterblade 1 which is fixed to the vertical extension 2' of a fixed structure 2, the latter having the shape of an L. The support 4 for the upper counterblade 5 is pivoted at the point 3 on the upper part of the fixed structure 2. The plate is placed between the two counterblades 1 and 5, the plate being capable of being inserted between the two counterblades due to the possibility of raising the upper counterblade 5. In the internal space which exists between the structures mentioned hereinabove is located the cutter block 6 which consists of a carriage having the shape of a C which extends longitudinally along the entire length of the device and which supports the upper blade 7 as well as the lower blade 8 corresponding to its extremities, the blades being shaped in such a manner as to present the concavity turned corresponding to the two counterblades, the lower blade being located so as to carry out the folding of the plate upwardly while the upper blade is located so as to carry out the folding of the plate downwardly. The location of the blades and the counterblades is achieved according to means well known in the art.

The cutter block 6 is supported and placed in motion by one or a plurality of fluid-dynamic cylinders 9 which have a shaft 10, the latter extending essentially vertically and which have the upper end pivoted onto the lower surface of the cutter block 6. Each one of the cylinders 9 has a lower extension 11 within which is formed axially a seat in which is inserted an eccentric element 12 placed on a shaft 13. The latter extends along the entire length of the device and is pivoted at 13' corresponding to its extremities on the fixed lateral sides of the device. In view of this arrangement, it is obvious that to each angular position of the shaft 13 corresponds an exact vertical position of the cylinder 9 and consequently also of the cutter block 6. As shown in the figures the eccentric elements 12 preferably have a circular shape.

It is preferable to provide supporting means for the shaft 13 disposed in proximity of each of the cylinders 9 capable of avoiding the bending of the shaft in the same areas.

The cutter block, corresponding to its rear side had a plurality of rolling elements 14 and 15 which roll on tracks 16 and 17, the tracks being arranged essentially vertically and presenting portions 18 at the extremities of curved shape which have a radius of curvature greater with respect to the radius of curvature of the rolling elements.

Figure 2:
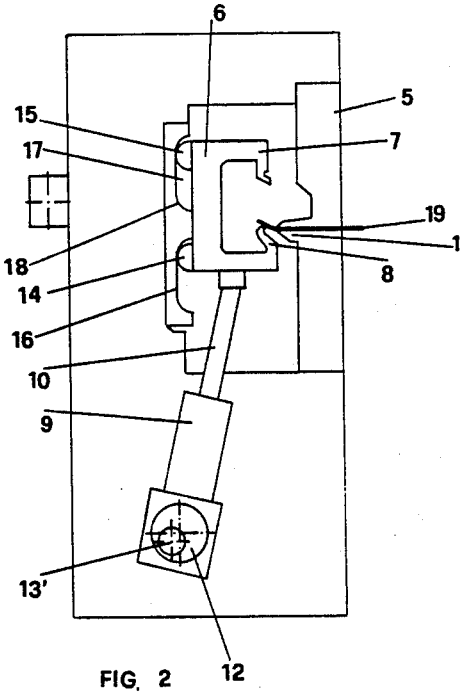
FIGS. 2 and 3 illustrate a schematic lateral view of a specific embodiment of the invention disposed to carry out an upward fold on a plate in two different phases of the operation.
Figure 3:
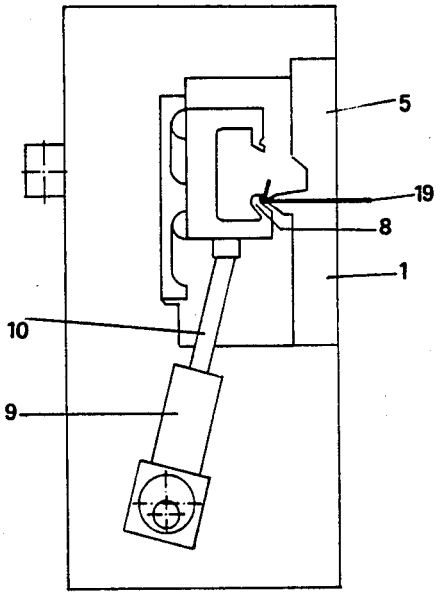

FIGS. 2 and 3 show that when the eccentric element 12 is rotated so that its axis is above the pivot 13' of the shaft, the folding press is arranged in such a manner to carry out the upward folding of the plate 19, the plate being held between the two counterblades 1 and 5. The figures also show that the more elevated is the position of the axis of the eccentric element with respect to the position of the pivot 13', the greater is the angle of the folding of the plate due to the fact that the course of the shaft 10 is always the same. The folding of the plates which takes place due to the great force exerted by the blade 8 and also due to the holding force exerted by the counterblades 1 and 5, is possible due to the fact that the cutter block 6 is intended, after a certain point, to carry out a motion of curvilinear shape so that the blade 7 becomes superimposed to the two counterblades from the time when the rolling elements 15 in their last portion of the travel along the track 16 do not perform a motion in a vertical direction but carry out a motion of curvilinear shape on the section 18.

Figure 4:
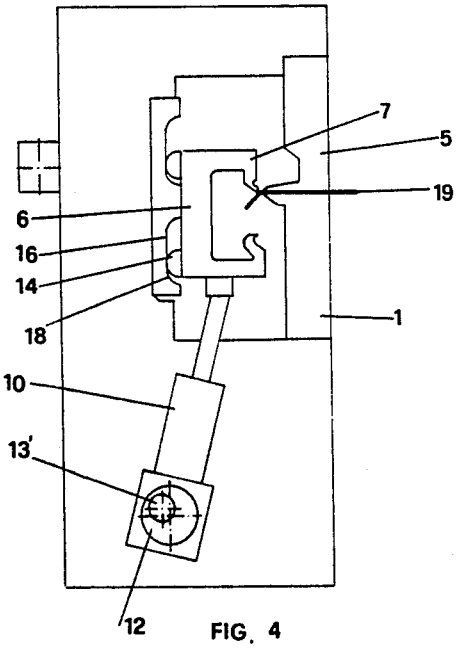
FIGS. 4 and 5 illustrate a schematic lateral view of a specific embodiment of the invention predisposed to carry out a downward fold on a plate in two different phases of the operation.
Figure 5:
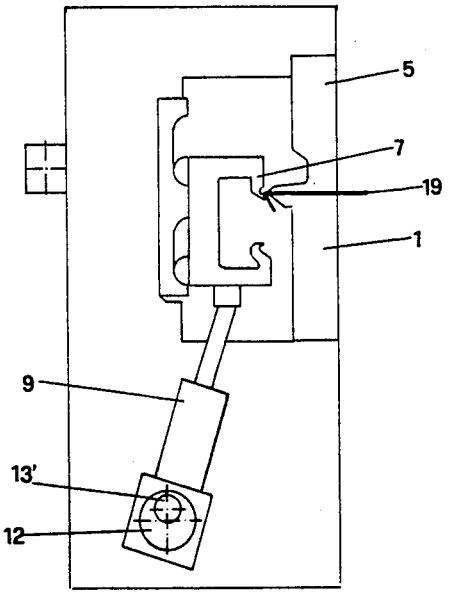

FIGS. 4 and 5 show that on the contrary when the axis of the eccentric element 12 is placed on a level lower with respect to the level of the axis of the pivot 13' of the shaft, the device of the present invention is capable of carrying out the downward folding of the plate 19. In particular this folding will be more accentuated the smaller is the portion of the axis of the eccentric element 12 with respect to the axis of the pivot 13'. Also in this case the folding action on the plate 19 is possible due to the particular profile of the portion of the lower extremity 18 of the lower track 16, because the rolling elements 14 along the track 16 compel the cutter block 6 to perform also in this case a course of curvilinear shape.

According to further embodiment of the invention it is possible to have a single track to replace the pair of tracks 16 and 17 described hereinabove, the single track having extremities of curved shape with the rolling elements 14 and 15 being adapted to run along the single track.

It is clear from the foregoing description that the device according to the present invention is particularly simple from a structural point of view in comparison with the devices known in the art intended to perform a similar function. It is also evident from the foregoing description that both the predetermination of the folding angle and the actuation of the same folding are inherently simpler in the device according to the present invention compared with the devices known in the art. Other means may be used for the purpose of varying the position of the cylinder 9 different from the means described hereinabove by way of example, as long as they are capable of ensuring the prearrangement of the cutter block 6 so as to obtain the desired folding of the plate 19 downwardly by means of the upper blade 7 or upwardly by means of the lower blade 8.

What is claimed is:

1. A folding press for a plate which comprises a fixed lower counterblade (1) and an upper counter blade (5) which is movable in the vertical direction with respect to said lower counterblade, said counterblade (1) and said counterblade (5) being adapted to hold a plate (19) therebetween, a cutter block (6) having a rear surface and being movable in the vertical direction with respect to said counterblades, a pair of folding blades (7), (8) capable of manufacturing panels folded along at least one side by action on a portion of the plate and protruding from said upper and said lower counterblades, said folding blades being supported by said cutter block at its extremities, a fixed L-shaped structure (2) defined by a vertical part and a horizontal part in the rear of said press, said structure (2) having a vertical extension (2') at the end of its horizontal part, said vertical extension being fixed to said lower counterblade (1), a support (4) in the upper part of said press pivoted at the rear thereof to said fixed structer (2), said upper counterblade (5) being fixed in the front part thereof to said structure (2), said cutter block (6) being located in the space comprised between said fixed structure (2), said support (4) and said counterblades (1) and (5), said cutter block (6) being C-shaped and being actuated in the vertical direction by at least one essentially vertical shaft (10), said shaft (10) being actuated by a fluid-dynamic cylinder (9) located in the horizontal part of said L-shaped structure (2), said shaft (10) being pivoted at its upper end onto the lower surface of said cutter block, said cutter block having on the rear surface thereof a plurality of rolling elements (14) and (15) having a radius of curvature, at least one track (16) and (17) disposed essentially in the verticle direction behind said rolling elements and on said vertical part of said fixed L-shaped structure, said rolling elements travelling on said track, said track having portions of curved shape at the extemites, said portions at said extremities (18) of said track having a curved profile, said curved profile having a radius of curvature which is greater than the radius of curvature of said rolling elements (15), said portions of the extremities of said track being placed at such a level whereby a curvilinear motion of the cutter block (6) results when the upper blade (7) or the lower blade (8) is placed in front of said counterblades, said cylinder (9) having a lower extremity, said press comprising means capable of continuously varying the position of the lower extremity of said cylinder (9).

2. A folding press according to claim 1 wherein a plurality of cylinders are provided, said means for varying continuously the position of the extremity of each of said cylinders (9) consist of a shaft (13) which extends in horizontal direction along the entire length of said press, said shaft (13) being pivoted at (13') on the fixed lateral side of said press, said shaft having a plurality of elements (12) eccentric with respect to said pivot point (13'), said eccentric elements being inserted in a seat formed on the lower extensions (11) of the said cylinders (9), said shaft (13) being capable of moving within said seat so as to assume the desired angular position.

3. The folding press according to claim 1 wherein two tracks (16) and (17) are provided, said rolling elements (14) and (15) moving on said tracks.

4. The following press according to claim 2 wherein each of said eccentric (12) has a circular shape, said element being so dimensioned that when the axis thereof is located above the axis of said pivot (13'), said plate (19) is folded upwardly due to the action of said lower blade (8) and when the axis thereof is located below the axis of said pivot (13'), said plate (19) is folded downwardly due to the action of said blade (7).

* * * * *